US012668341B2

(12) United States Patent
Tanimura

(10) Patent No.: US 12,668,341 B2
(45) Date of Patent: Jun. 30, 2026

(54) MARINE PROPULSION DEVICE AND MARINE VESSEL

(71) Applicant: YAMAHA HATSUDOKI KABUSHIKI KAISHA, Iwata (JP)

(72) Inventor: Keiichi Tanimura, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 393 days.

(21) Appl. No.: 18/429,511

(22) Filed: Feb. 1, 2024

(65) Prior Publication Data

US 2024/0262475 A1 Aug. 8, 2024

(30) Foreign Application Priority Data

Feb. 7, 2023 (JP) ..... 2023-017120

(51) Int. Cl.
*B63H 1/16* (2006.01)
*B63H 23/00* (2006.01)
*B63H 23/24* (2006.01)

(52) U.S. Cl.
CPC ..... *B63H 1/16* (2013.01); *B63H 23/24* (2013.01); *B63H 2023/005* (2013.01)

(58) Field of Classification Search
CPC .... B63H 1/16; B63H 23/24; B63H 2023/005; B63H 5/14; H02P 6/17; H02P 6/153
See application file for complete search history.

(56) References Cited

U.S. PATENT DOCUMENTS

| | | | | |
|---|---|---|---|---|
| 8,390,277 | B2 * | 3/2013 | Takeuchi | G01D 5/2458 324/207.25 |
| 9,074,866 | B2 * | 7/2015 | Suzuki | B60L 50/16 |
| 10,167,067 | B2 * | 1/2019 | Suzuki | B63H 21/21 |
| 10,763,772 | B1 * | 9/2020 | Fatemi | H02P 25/086 |
| 11,876,477 | B2 * | 1/2024 | Pollock | G01R 15/181 |
| 2010/0321008 | A1 * | 12/2010 | Mita | G01D 5/145 324/207.25 |
| 2012/0081054 | A1 * | 4/2012 | Hisada | H02P 25/24 318/400.41 |
| 2020/0052639 | A1 * | 2/2020 | Ishida | H02K 3/12 |
| 2022/0017198 | A1 | 1/2022 | Tsukada et al. | |

(Continued)

FOREIGN PATENT DOCUMENTS

| | | | |
|---|---|---|---|
| EP | 2591993 | A1 | 5/2013 |
| JP | 2013-132200 | A | 7/2013 |

(Continued)

OTHER PUBLICATIONS

"Ramidi, Priyatham; et. al.; System Identification for Control of a Bow Thruster With Brushless Motor and Shaft-Less Propeller; Nov. 2018; ASME; International Mechanical Engineering Congress and Exposition, Nov. 9-15, 2018" (Year: 2018).*

(Continued)

*Primary Examiner* — Ramya P Burgess
*Assistant Examiner* — Christopher R Cardimino
(74) *Attorney, Agent, or Firm* — Keating & Bennett, LLP

(57) ABSTRACT

A marine propulsion device includes a controller configured or programmed to calculate a rotation speed of a rotor based on a magnetic flux density detected by a detector, and correct a deviation in a calculated magnet position of the rotor due to an eddy current generated in a metal based on the calculated rotation speed of the rotor.

20 Claims, 5 Drawing Sheets

(56) References Cited

U.S. PATENT DOCUMENTS

| | | | | |
|---|---|---|---|---|
| 2022/0120789 | A1* | 4/2022 | Furukawa | G01R 33/038 |
| 2025/0132708 | A1* | 4/2025 | Zhang | H02P 21/18 |

FOREIGN PATENT DOCUMENTS

| | | | | |
|---|---|---|---|---|
| JP | 2013207980 | A | * | 10/2013 |
| JP | 2015-89198 | A | | 5/2015 |
| JP | 2016-158499 | A | | 9/2016 |
| JP | 6135248 | B2 | * | 5/2017 |
| JP | 2021135117 | A | * | 9/2021 |
| JP | 2022-18646 | A | | 1/2022 |

OTHER PUBLICATIONS

Official Communication issued in corresponding European Patent Application No. 24150064.4, mailed on Jul. 2, 2024, 5 pages.

* cited by examiner

MARINE PROPULSION DEVICE AND MARINE VESSEL

CROSS REFERENCE TO RELATED APPLICATIONS

This application claims the benefit of priority to Japanese Patent Application No. 2023-017120 filed on Feb. 7, 2023. The entire contents of this application are hereby incorporated herein by reference.

BACKGROUND OF THE INVENTION

1. Field of the Invention

The present invention relates to marine propulsion devices and marine vessels.

2. Description of the Related Art

A marine propulsion device including a duct including a stator, and a propeller including a rim that includes a rotor facing the stator is known in general. Such a marine propulsion device is disclosed in Japanese Patent Laid-Open No. 2022-018646, for example.

Japanese Patent Laid-Open No. 2022-018646 discloses an outboard motor (marine propulsion device) including a duct including a stator, and a propeller including a rim that includes a rotor located radially inwardly of the stator so as to face the stator, and blades provided radially inwardly of the rim.

Although not disclosed in Japanese Patent Laid-Open No. 2022-018646, a conventional outboard motor (marine propulsion device) as disclosed in Japanese Patent Laid-Open No. 2022-018646 includes a detector that detects a magnetic flux density generated by a magnet of a rotor. Furthermore, the conventional outboard motor includes a controller that calculates a magnet position of the rotor based on the magnetic flux density detected by the detector and performs a control to apply a current to a stator at the timing at which the rotor is able to obtain a maximum torque based on the calculated magnet position of the rotor. Moreover, the detector faces the rotor.

In the conventional outboard motor (marine propulsion device) as disclosed in Japanese Patent Laid-Open No. 2022-018646, it is necessary to make the detector waterproof due to the characteristics of outboard motors that are driven in water, and thus the detector is housed in a sealed member. Generally, a housing of an outboard motor is made of metal. That is, a detector faces a rotor via a metal. In such a case, a deviation occurs in the calculated magnet position of the rotor. Therefore, in the conventional outboard motor (marine propulsion device) as disclosed in Japanese Patent Laid-Open No. 2022-018646, even when the controller performs a control to apply a current to the stator at the timing at which the rotor is able to obtain a maximum torque based on the calculated magnet position of the rotor, the rotor does not obtain the maximum torque. That is, an output of a motor including the stator and the rotor decreases. Therefore, it is desired to improve an output of a motor including a stator and a rotor in an outboard motor (marine propulsion device) and a marine vessel each including a duct including the stator, and a propeller including a rim that includes the rotor facing the stator.

SUMMARY OF THE INVENTION

Example embodiments of the present invention provide marine propulsion devices and marine vessels each including ducts including stators, and propellers including rims that include rotors facing the stators and in which outputs of motors including the stators and the rotors are improved.

A marine propulsion device according to an example embodiment of the present invention includes a duct including a stator, a propeller including a rim including a rotor radially inward of the stator and facing the stator, and blades radially inward of the rim, a detector facing the rotor via a metal to detect a magnetic flux density generated by a magnet of the rotor, and a controller configured or programmed to calculate a magnet position of the rotor based on the magnetic flux density detected by the detector, and perform a control to apply a current to the stator at a timing at which the rotor is able to obtain a maximum torque based on the calculated magnet position of the rotor. The controller is configured or programmed to calculate a rotation speed of the rotor based on the magnetic flux density detected by the detector, and correct a deviation in the calculated magnet position of the rotor due to an eddy current generated in the metal based on the calculated rotation speed of the rotor.

In a marine propulsion device according to an example embodiment of the present invention, the controller is configured or programmed to calculate the rotation speed of the rotor based on the magnetic flux density detected by the detector, and correct the deviation in the calculated magnet position of the rotor due to the eddy current generated in the metal based on the calculated rotation speed of the rotor. Accordingly, even when a deviation occurs in the calculated magnet position of the rotor due to the eddy current generated in the metal, the deviation in the calculated magnet position of the rotor due to the eddy current generated in the metal is corrected based on the rotation speed of the rotor. The rotation speed of the rotor is calculated based on a length of time for one cycle of the magnetic flux density corresponding to an electrical angle of 360 degrees, and thus the rotation speed of the rotor is accurately detected even when a deviation occurs in the calculated magnet position of the rotor. Therefore, a current is applied to the stator at the timing at which the rotor is able to obtain a maximum torque based on the calculated magnet position of the rotor with the corrected deviation. That is, the rotor obtains the maximum torque. Consequently, in a structure including the duct including the stator, and the propeller including the rim that includes the rotor facing the stator, an output of a motor including the stator and the rotor is improved.

In a marine propulsion device according to an example embodiment of the present invention, the detector is preferably adjacent to the stator in an axial direction of the rotor and preferably faces the rotor. Accordingly, even when the rotor faces the stator, the detector faces the rotor.

In a marine propulsion device according to an example embodiment of the present invention, the detector is preferably accommodated in a space inside a storage area defined by the metal and located in an upper portion of the duct. Accordingly, the detector is located on a relatively upper side of the duct. Therefore, as compared with a case in which the detector is accommodated in a portion of the duct other than the storage area located in the upper portion, the detector is located relatively close to the controller that is also located above the duct. Consequently, complex routing of a signal line connecting the detector to the controller is reduced or prevented.

In such a case, a marine propulsion device preferably further includes a housing above the duct, the controller is preferably accommodated in a space inside the housing, and the space inside the storage area in which the detector is accommodated is preferably connected to the space inside the housing in which the controller is accommodated. Accordingly, the space in which the detector is accommodated is connected to the space in which the controller is accommodated, and thus the signal line connecting the detector to the controller is easily routed.

In a marine propulsion device according to an example embodiment of the present invention, three-phase AC power is preferably supplied to the stator, the detector preferably includes three detectors to detect three-phase magnetic flux densities generated by the magnet of the rotor, respectively, and the controller is preferably configured or programmed to calculate the rotation speed of the rotor based on one of the three-phase magnetic flux densities detected by the three detectors, respectively, and correct deviations in magnet positions of the rotor calculated based on the three-phase magnetic flux densities, respectively, based on a calculated rotation speed of the rotor. Accordingly, in a structure in which three-phase AC power is supplied, the rotor obtains the maximum torque.

In such a case, the three detectors are preferably aligned along an alignment direction perpendicular to an axial direction of the rotor in a horizontal plane, and a thickness of the metal between the rotor and one of the three detectors located at a center in the alignment direction is preferably different from a thickness of the metal between the rotor and another one of the three detectors located on a first side in the alignment direction and a thickness of the metal between the rotor and another one of the three detectors located on a second side in the alignment direction. Accordingly, the width of a gap between a surface of the metal on the rotor side and the outer peripheral surface of the rim including the rotor at a position corresponding to the detector located at the center in the assignment direction is smaller than the width of a gap between the surface of the metal on the rotor side and the outer peripheral surface of the rim including the rotor at a position corresponding to the detector located on the first side in the alignment direction and the width of a gap between the surface of the metal on the rotor side and the outer peripheral surface of the rim including the rotor at a position corresponding to the detector located on the second side in the alignment direction. Consequently, even when the three detectors are aligned along the alignment direction perpendicular to the axial direction of the rotor in the horizontal plane, an excessively uneven width of the gap between the inner peripheral surface of the duct and the outer peripheral surface of the rim is reduced or prevented.

A marine propulsion device according to an example embodiment of the present invention preferably further includes a storage to store correction information indicating a relationship between the rotation speed of the rotor and a correction value to correct the deviation in the calculated magnet position of the rotor, and the controller is preferably configured or programmed to correct the deviation in the calculated magnet position of the rotor based on the calculated rotation speed of the rotor and the correction information. Accordingly, the deviation in the calculated magnet position of the rotor is easily corrected based on the calculated rotation speed of the rotor and the correction information stored in the storage.

In such a case, the storage is preferably operable to store the correction information for an entire range of the rotation speed of the rotor. Accordingly, the deviation in the calculated magnet position of the rotor is easily corrected over the entire range of the rotation speed of the rotor.

In a marine propulsion device further including the storage to store the correction information, the storage is preferably operable to store the correction information represented by a mathematical formula, a map, or a table. Accordingly, the correction information is easily stored in the storage using the mathematical formula, the map, or the table.

In such a case, the storage is preferably operable to store the correction information represented by the mathematical formula, and the controller is preferably configured or programmed to calculate the correction value based on the calculated rotation speed of the rotor and the correction information represented by the mathematical formula, and correct the deviation in the calculated magnet position of the rotor based on the calculated correction value. Accordingly, when the correction information is stored in the storage using the mathematical formula, the deviation in the calculated magnet position of the rotor is easily corrected based on the calculated rotation speed of the rotor and the correction information stored in the storage.

A marine vessel according to an example embodiment of the present invention includes a hull, and a marine propulsion device attached to the hull. The marine propulsion device includes a duct including a stator, a propeller including a rim including a rotor radially inward of the stator and facing the stator, and blades radially inward of the rim, a detector facing the rotor via a metal to detect a magnetic flux density generated by a magnet of the rotor, and a controller configured or programmed to calculate a magnet position of the rotor based on the magnetic flux density detected by the detector, and perform a control to apply a current to the stator at a timing at which the rotor is able to obtain a maximum torque based on the calculated magnet position of the rotor. The controller is configured or programmed to calculate a rotation speed of the rotor based on the magnetic flux density detected by the detector, and correct a deviation in the calculated magnet position of the rotor due to an eddy current generated in the metal based on the calculated rotation speed of the rotor.

In a marine vessel according to an example embodiment of the present invention, the controller is preferably configured or programmed to calculate the rotation speed of the rotor based on the magnetic flux density detected by the detector, and correct the deviation in the calculated magnet position of the rotor due to the eddy current generated in the metal based on the calculated rotation speed of the rotor. Accordingly, similarly to the marine propulsion devices according to example embodiments of the present invention described above, even when a deviation occurs in the calculated magnet position of the rotor due to the eddy current generated in the metal, the deviation in the calculated magnet position of the rotor due to the eddy current generated in the metal is corrected based on the rotation speed of the rotor. Therefore, similarly to the marine propulsion devices according to example embodiments of the present invention described above, the rotor obtains the maximum torque. Consequently, similarly to the marine propulsion devices according to example embodiments of the present invention described above, in a structure including the duct including the stator, and the propeller including the rim that includes the rotor facing the stator, an output of a motor including the stator and the rotor is improved.

In a marine vessel according to an example embodiment of the present invention, the detector is preferably adjacent to the stator in an axial direction of the rotor and preferably faces the rotor. Accordingly, similarly to the marine propulsion devices according to example embodiments of the present invention described above, even when the rotor faces the stator, the detector faces the rotor.

In a marine vessel according to an example embodiment of the present invention, the detector is preferably accommodated in a space inside a storage area made of the metal and located in an upper portion of the duct. Accordingly, similarly to the marine propulsion devices according to example embodiments of the present invention described above, complex routing of a signal line connecting the detector to the controller is reduced or prevented.

In such a case, the marine propulsion device preferably further includes a housing above the duct, the controller is preferably accommodated in a space inside the housing, and the space inside the storage area in which the detector is accommodated is preferably connected to the space inside the housing in which the controller is accommodated. Accordingly, similarly to the marine propulsion devices according to example embodiments of the present invention described above, the space in which the detector is accommodated is connected to the space in which the controller is accommodated, and thus the signal line connecting the detector to the controller is easily routed.

In a marine vessel according to an example embodiment of the present invention, three-phase AC power is preferably supplied to the stator, the detector preferably includes three detectors to detect three-phase magnetic flux densities generated by the magnet of the rotor, respectively, and the controller is preferably configured or programmed to calculate the rotation speed of the rotor based on one of the three-phase magnetic flux densities detected by the three detectors, respectively, and correct deviations in magnet positions of the rotor calculated based on the three-phase magnetic flux densities, respectively, based on a calculated rotation speed of the rotor. Accordingly, similarly to the marine propulsion devices according to example embodiments of the present invention described above, in a structure in which three-phase AC power is supplied, the rotor obtains the maximum torque.

In such a case, the three detectors are preferably aligned along an alignment direction perpendicular to an axial direction of the rotor in a horizontal plane, and a thickness of the metal between the rotor and one of the three detectors located at a center in the alignment direction is preferably different from a thickness of the metal between the rotor and another one of the three detectors located on a first side in the alignment direction and a thickness of the metal between the rotor and another one of the three detectors located on a second side in the alignment direction. Accordingly, similarly to the marine propulsion devices according to example embodiments of the present invention described above, even when the three detectors are aligned along the alignment direction perpendicular to the axial direction of the rotor in the horizontal plane, an excessively uneven width of a gap between the inner peripheral surface of the duct and the outer peripheral surface of the rim is reduced or prevented.

In a marine vessel according to an example embodiment of the present invention, the marine propulsion device preferably further includes a storage to store correction information indicating a relationship between the rotation speed of the rotor and a correction value to correct the deviation in the calculated magnet position of the rotor, and the controller is preferably configured or programmed to correct the deviation in the calculated magnet position of the rotor based on the calculated rotation speed of the rotor and the correction information. Accordingly, similarly to the marine propulsion devices according to example embodiments of the present invention described above, the deviation in the calculated magnet position of the rotor is easily corrected based on the calculated rotation speed of the rotor and the correction information stored in the storage.

In such a case, the storage is preferably operable to store the correction information for an entire range of the rotation speed of the rotor. Accordingly, similarly to the marine propulsion devices according to example embodiments of the present invention described above, the deviation in the calculated magnet position of the rotor is easily corrected over the entire range of the rotation speed of the rotor.

In a marine vessel further including the storage to store the correction information, the storage is preferably operable to store the correction information represented by a mathematical formula, a map, or a table. Accordingly, similarly to the marine propulsion devices according to example embodiments of the present invention described above, the correction information is easily stored in the storage using the mathematical formula, the map, or the table.

In such a case, the storage is preferably operable to store the correction information represented by the mathematical formula, and the controller is preferably configured or programmed to calculate the correction value based on the calculated rotation speed of the rotor and the correction information represented by the mathematical formula, and correct the deviation in the calculated magnet position of the rotor based on the calculated correction value. Accordingly, similarly to the marine propulsion devices according to example embodiments of the present invention described above, when the correction information is stored in the storage using the mathematical formula, the deviation in the calculated magnet position of the rotor is easily corrected based on the calculated rotation speed of the rotor and the correction information stored in the storage.

The above and other elements, features, steps, characteristics and advantages of the present invention will become more apparent from the following detailed description of the example embodiments with reference to the attached drawings.

DETAILED DESCRIPTION OF THE EXAMPLE EMBODIMENTS

Example embodiments of the present invention are hereinafter described with reference to the drawings.

A marine propulsion device 100 and a marine vessel 110 according to example embodiments of the present invention are now described with reference to FIGS. 1 to 8.

Figure 1:
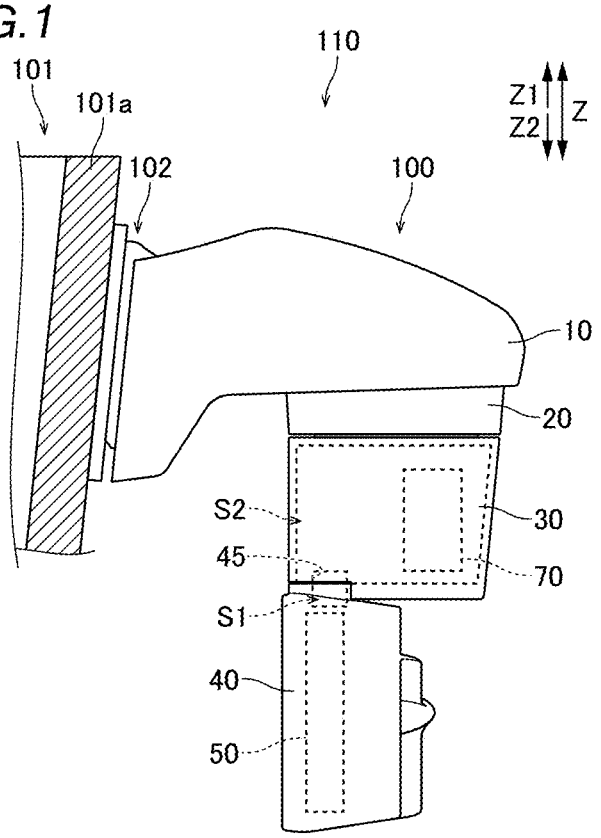
FIG. 1 is a side view of a marine propulsion device according to an example embodiment of the present invention.

As shown in FIG. 1, the marine vessel 110 includes a hull 101, a bracket 102, and the marine propulsion device 100. The marine propulsion device 100 is attached to a stern 101*a* of the hull 101 via the bracket 102. That is, the marine propulsion device 100 is an outboard motor to propel the marine vessel 110. The marine vessel 110 may be a relatively small marine vessel used for sightseeing or fishing, for example.

The marine propulsion device 100 includes a cowling 10, an upper case 20, a lower case 30, a duct 40, and a propeller 50. The cowling 10, the upper case 20, the lower case 30, the duct 40, and the propeller 50 are aligned in this order from the top (Z1 side) to the bottom (Z2 side) of the marine propulsion device 100. That is, the lower case 30 is located above the duct 40. The lower case 30 is an example of a "housing".

In the following description, the upward-downward direction of the marine propulsion device 100 is defined as a Z direction. The upper side and the lower side of the marine propulsion device 100 are defined as the Z1 side and the Z2 side, respectively. Furthermore, the axial direction, radial direction, and circumferential direction of a rotor 54 (see FIG. 3) described below are defined as an A direction, an R direction, and a C direction, respectively. A first side (hull 101 side) and a second side (a side opposite to the hull 101 side) in the axial direction (A direction) of the rotor 54 are defined as an A1 side and an A2 side, respectively. The radially inner side and the radially outer side of the rotor 54 are defined as an R1 side and an R2 side, respectively. The central axis 90 (see FIG. 2) of the propeller 50 extends along the A direction.

The cowling 10 is attached to the stern 101*a* of the hull 101 via the bracket 102. The cowling 10 and the upper case 20 are fixed to each other. The lower case 30 and the duct 40 are fixed to each other. The lower case 30 and the duct 40 are rotatable in the right-left direction of the marine propulsion device 100 with respect to the cowling 10 and the upper case 20. The lower case 30 and the duct 40 are rotated with respect to the cowling 10 and the upper case 20 such that the orientation of the propeller 50 with respect to the hull 101 is changed.

Figure 2:
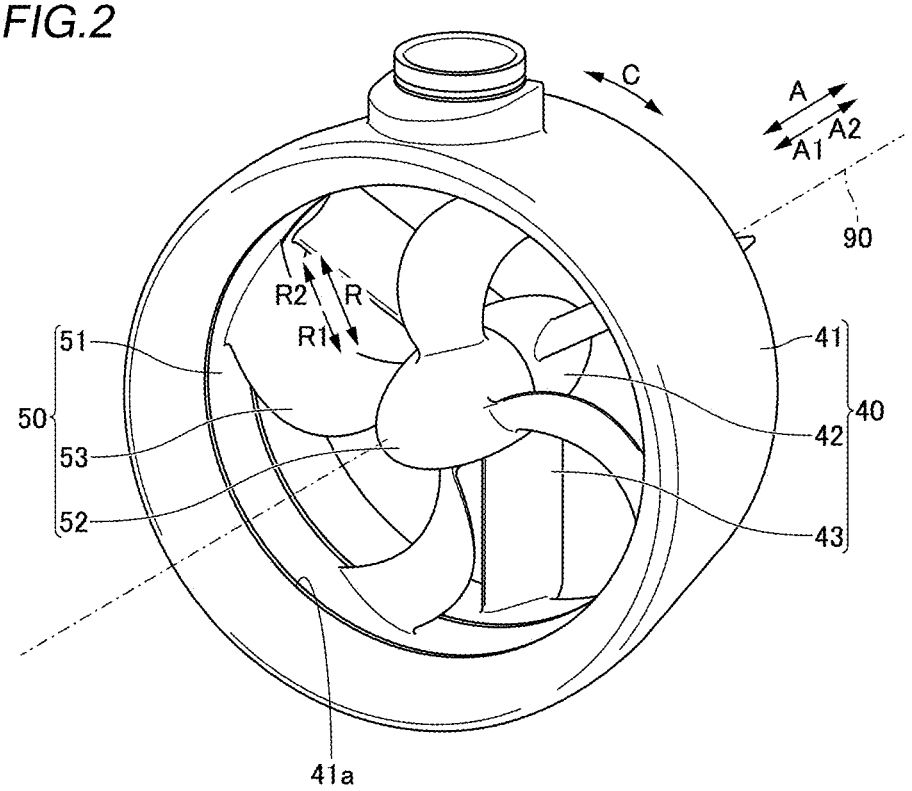
FIG. 2 is a perspective view of a duct and a rim of a marine propulsion device according to an example embodiment of the present invention.

As shown in FIG. 2, the duct 40 includes a cylindrical duct ring 41, a duct hub 42 provided on the R1 side of the duct ring 41 and extending along the A direction, and a plurality of fins 43 extending in the R direction to connect the duct hub 42 to the duct ring 41.

The propeller 50 includes an annular rim 51, a propeller hub 52 provided on the R1 side of the rim 51 and extending along the A direction, and a plurality of blades 53 extending in the R direction to connect the propeller hub 52 to the rim 51. That is, the plurality of blades 53 are provided on the R1 side of the rim 51.

The propeller hub 52 is supported by the duct hub 42 so as to be rotatable in the C direction with respect to the duct hub 42. That is, the propeller 50 including the propeller hub 52 is rotatable in the C direction with respect to the duct 40 including the duct hub 42. Rotation of the propeller 50 generates a thrust to propel the marine vessel 110.

An annular recess 41*a* is provided on a surface of the duct ring 41 on the R1 side. The rim 51 of the propeller 50 is located in the annular recess 41*a*.

Figure 3:
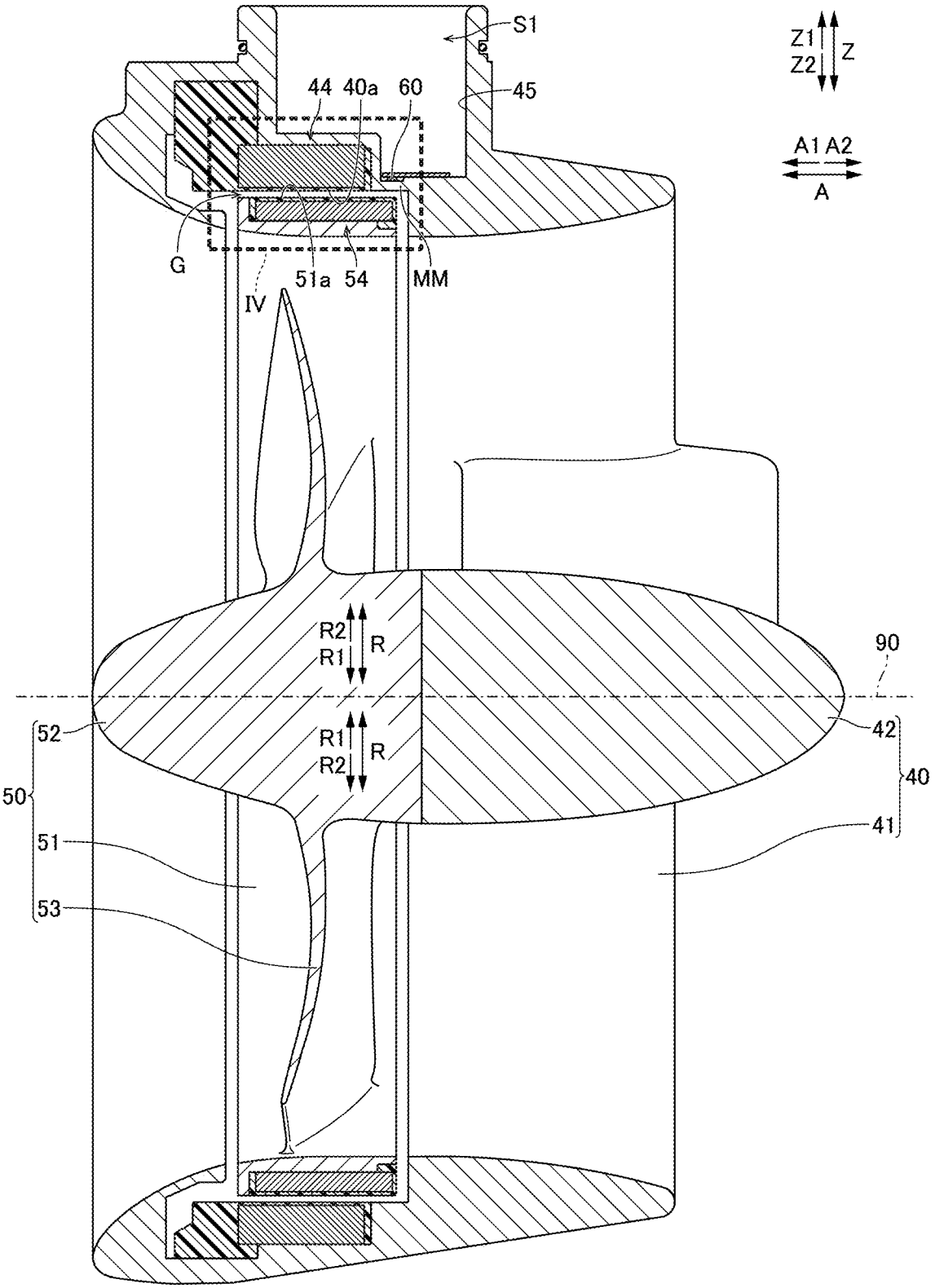
FIG. 3 is a sectional view illustrating the structure of a duct and a rim of a marine propulsion device according to an example embodiment of the present invention.

As shown in FIG. 3, the duct ring 41 (duct 40) includes a stator 44. The stator 44 includes an annular stator core (not shown) including a plurality of slots, and coils (not shown) in the plurality of slots of the stator core. Three-phase AC power is supplied to the coils of the stator 44. The rim 51 (propeller 50) includes the rotor 54. The rotor 54 includes an annular rotor core (not shown) and a magnet (not shown) embedded in the rotor core. The rotor 54 is located on the R1 side of the stator 44 so as to face the stator 44. A motor that rotates the propeller 50 includes the stator 44 and the rotor 54. That is, the marine propulsion device 100 is an electric outboard motor.

Figure 4:
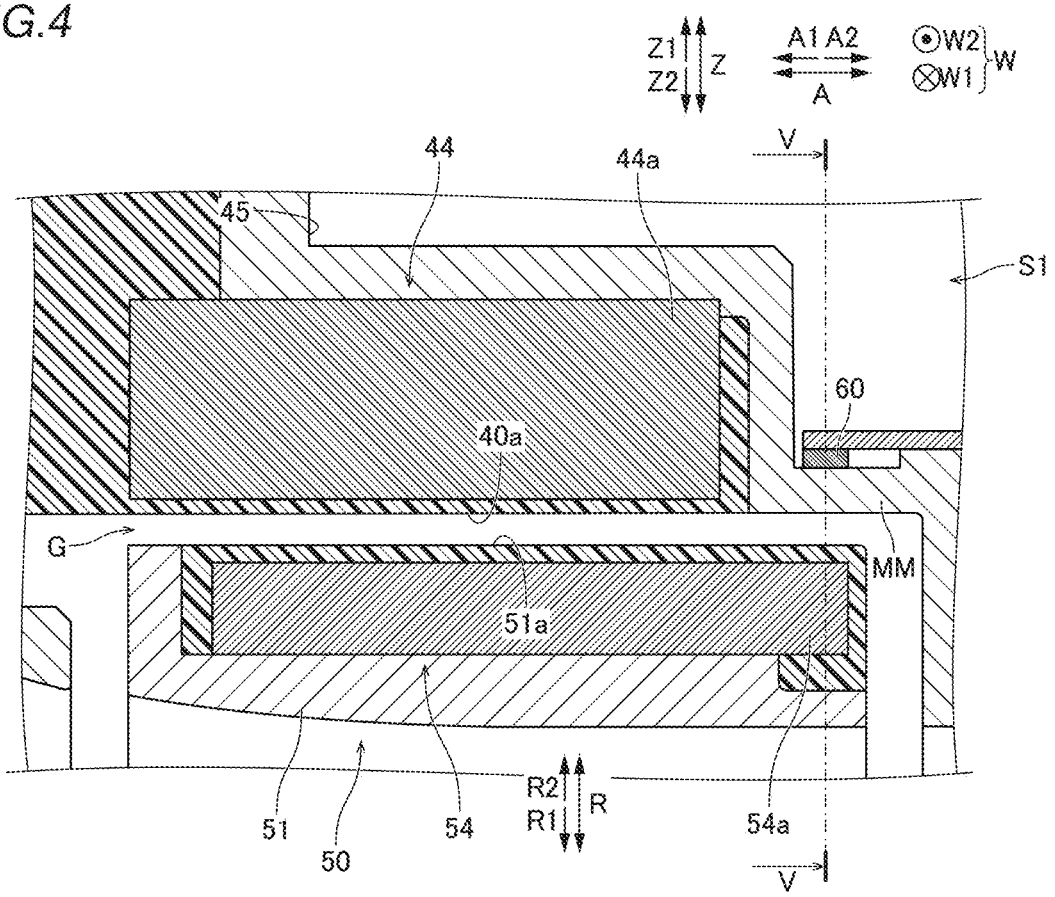
FIG. 4 is an enlarged view of a portion IV in FIG. 3.
Figure 5:
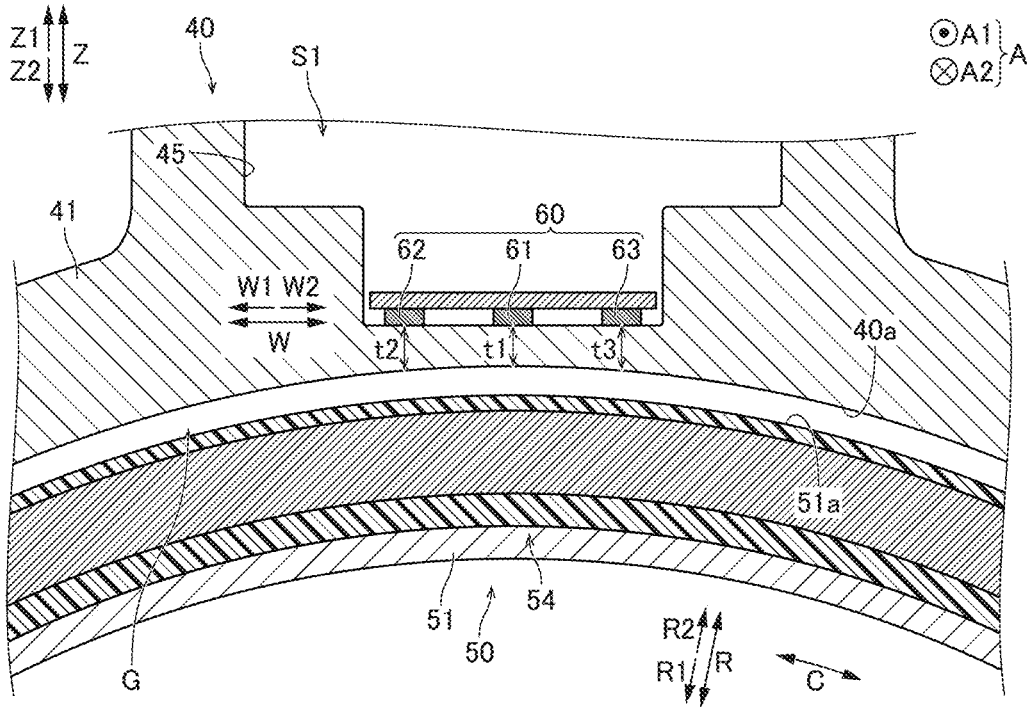
FIG. 5 is sectional view taken along the line V-V in FIG. 4.

As shown in FIG. 4, a gap G is provided between the outer peripheral surface 51*a* of the rim 51 and the inner peripheral surface 40*a* of the duct 40 in the R direction. The gap G extends along the A direction. An end 54*a* of the rotor 54 on the A2 side and an end 44*a* of the stator 44 on the A2 side are deviated from each other in the A direction. As shown in FIG. 5, the gap G extends along the C direction.

As shown in FIG. 4, each of the rotor 54 and the stator 44 is covered with a resin. Thus, the gap G is defined by the outer peripheral surface 51*a* of the rim 51 made of the resin covering the rotor 54 and the inner peripheral surface 40*a* of the duct 40 made of the resin covering the stator 44.

Figure 6:
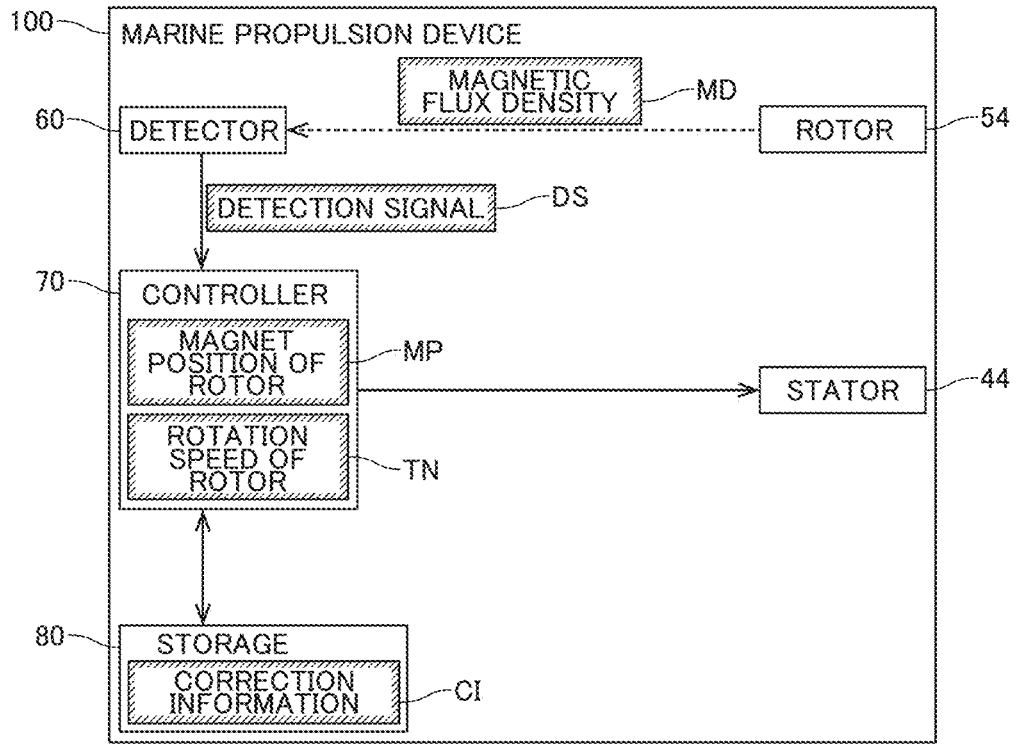
FIG. 6 is a block diagram of a control system of a marine propulsion device according to an example embodiment of the present invention.

As shown in FIG. 6, the marine propulsion device 100 includes detectors 60, a controller 70, and a storage 80.

Each of the detectors 60 includes a magnetic sensor. The detectors 60 detect magnetic flux densities MD generated by the magnet of the rotor 54. The detectors 60 output detection signals DS to the controller 70 based on the timing (detection points in FIG. 7) at which the magnetic flux densities MD exceed a predetermined threshold TH (see FIG. 7). As shown in FIG. 4, the detectors 60 are adjacent to the stator 44 on the A2 side of the stator 44 in the A direction and face the rotor 54.

As shown in FIG. 5, three detectors 60 are provided to detect three-phase magnetic flux densities MD (see FIG. 7) generated by the magnet of the rotor 54, respectively. The three detectors 60 are aligned along an alignment direction (W direction) perpendicular to the A direction in a horizontal plane. The W direction extends in the right-left direction of the marine propulsion device 100.

As shown in FIG. 6, the controller 70 includes a processor such as a central processing unit (CPU). The controller 70 calculates a magnet position MP of the rotor 54 based on the detection signals DS input from the detectors 60. That is, the controller 70 calculates the magnet position MP of the rotor 54 based on the magnetic flux densities MD detected by the detectors 60. Then, the controller 70 performs a control to apply three-phase alternating currents to the coils of the stator 44 at the timing at which the rotor 54 is able to obtain a maximum torque based on the calculated magnet position MP of the rotor 54. As shown in FIG. 1, the controller 70 is accommodated in a space S2 inside the lower case 30.

As shown in FIG. 6, the storage 80 includes a nonvolatile memory. The storage 80 stores programs etc. used by the controller 70.

As shown in FIG. 4, the detectors 60 face the rotor 54 via a metal (aluminum, for example) member MM. Specifically, the detectors 60 are accommodated in a space S1 inside a storage area 45 made of the metal MM and located in an upper portion of the duct 40. As shown in FIG. 1, the space S1 inside the storage area 45 in which the detectors 60 are accommodated is connected to the space S2 inside the lower case 30 in which the controller 70 is accommodated.

Figure 7:
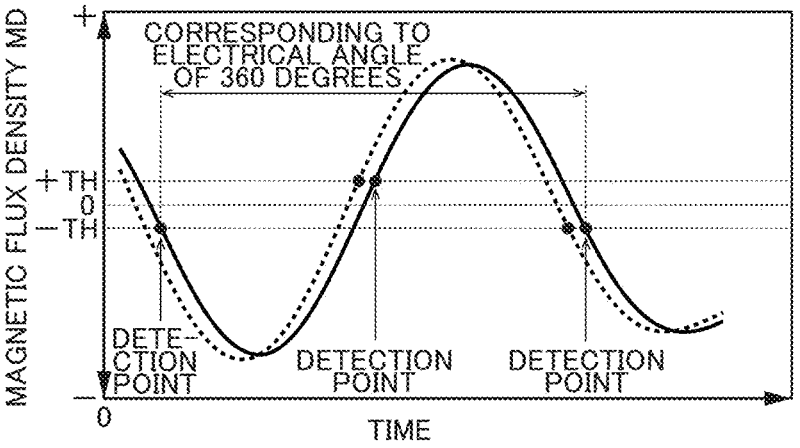
FIG. 7 is a diagram illustrating a deviation in a calculated magnet position of a rotor caused by eddy currents generated in a metal in a marine propulsion device according to an example embodiment of the present invention.

Therefore, as shown in FIG. 7, the phases of the magnetic flux densities MD detected by the detectors 60 (see FIG. 6) are shifted due to eddy currents generated in the metal MM. Accordingly, the magnet position MP (see FIG. 6) of the rotor 54 (see FIG. 4) calculated by the controller 70 (see FIG. 6) based on the detection signals DS (see FIG. 6) input from the detectors 60 is deviated. In FIG. 7, a change over time of the magnetic flux when one of the detectors 60 faces the rotor 54 via the metal MM, and a change over time of the magnetic flux when the detector 60 faces the rotor 54 via air are shown by solid and dotted lines, respectively.

As shown in FIG. 6, the controller 70 calculates the rotation speed TN of the rotor 54 based on the magnetic flux densities MD detected by the detectors 60. Then, the controller 70 corrects a deviation in the calculated magnet position MP of the rotor 54 due to the eddy currents generated in the metal MM based on the calculated rotation speed TN of the rotor 54.

Specifically, the controller 70 calculates the rotation speed TN of the rotor 54 based on a length of time for one cycle of the magnetic flux densities MD detected by the detectors 60, which corresponds to an electrical angle of 360 degrees (see FIG. 7). The storage 80 stores correction information CI indicating the relationship between the rotation speed TN of the rotor 54 and a correction value CV (see FIG. 8) to correct the deviation in the calculated magnet position MP of the rotor 54. Then, the controller 70 corrects the deviation in the calculated magnet position MP of the rotor 54 due to the eddy currents generated in the metal MM (see FIG. 4) based on the calculated rotation speed TN of the rotor 54 and the correction information CI stored in the storage 80.

Figure 8:
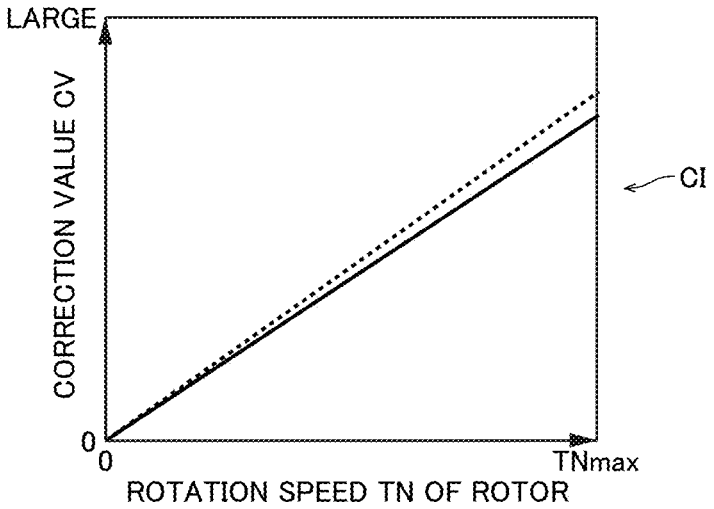
FIG. 8 is a diagram illustrating correction information stored in a storage of a marine propulsion device according to an example embodiment of the present invention.

As shown in FIG. 8, the storage 80 (see FIG. 6) stores the correction information CI for the entire range of the rotation speed TN of the rotor 54. The storage 80 stores the correction information CI represented by a mathematical formula. In the correction information CI, the rotation speed TN of the rotor 54 and the correction value CV are represented by a linear function.

As shown in FIG. 6, the controller 70 calculates the correction value CV (see FIG. 8) based on the calculated rotation speed TN of the rotor 54 and the correction information CI represented by the mathematical formula. Then, the controller 70 corrects the deviation in the calculated magnet position MP of the rotor 54 based on the calculated correction value CV.

As shown in FIG. 5, the thickness t1 of the metal MM between the rotor 54 and a detector 61 located at the center in the W direction among the three detectors 60 is different from the thickness t2 of the metal MM between the rotor 54 and a detector 62 located on the W1 side (a first side in the W direction) among the three detectors 60 and the thickness t3 of the metal MM between the rotor 54 and a detector 63 located on the W2 side (a second side in the W direction) among the three detectors 60. Therefore, a deviation in the magnet position MP (see FIG. 6) of the rotor 54 calculated based on a magnetic flux density MD (see FIG. 6) detected by the detector 61 is different from a deviation in the magnet position MP of the rotor 54 calculated based on a magnetic flux density MD detected by the detector 62 and a deviation in the magnet position MP of the rotor 54 calculated based on a magnetic flux density MD detected by the detector 63.

Therefore, as shown in FIG. 8, the controller 70 (see FIG. 6) calculates the rotation speed TN of the rotor 54 based on one of the three-phase magnetic flux densities MD (see FIG. 7) detected by the three detectors 60 (see FIG. 5). Then, the controller 70 corrects the deviations in the magnet positions MP of the rotor 54 calculated based on the three-phase magnetic flux densities MD, respectively, based on the calculated rotation speed TN of the rotor 54. The thickness t2 (see FIG. 5) is the same or substantially the same as the thickness t3 (see FIG. 5), and thus the correction value CV for the deviation in the magnet position MP of the rotor 54 calculated based on the magnetic flux density MD detected by the detector 62 (see FIG. 5) is the same or substantially the same as the correction value CV for the deviation in the magnet position MP of the rotor 54 calculated based on the magnetic flux density MD detected by the detector 63 (see FIG. 5). In FIG. 8, the correction information CI to correct the deviation in the magnet position MP of the rotor 54 calculated based on the magnetic flux density MD detected by the detector 61 is shown by a solid line, and the correction information CI to correct the deviation in the magnet position MP of the rotor 54 calculated based on the magnetic flux density MD detected by the detector 62 and the correction information CI to correct the deviation in the magnet position MP of the rotor 54 calculated based on the magnetic flux density MD detected by the detector 63 are shown by a dotted line.

A control flow by the controller 70 of the marine propulsion device 100 is now described with reference to FIG. 9.

Figure 9:
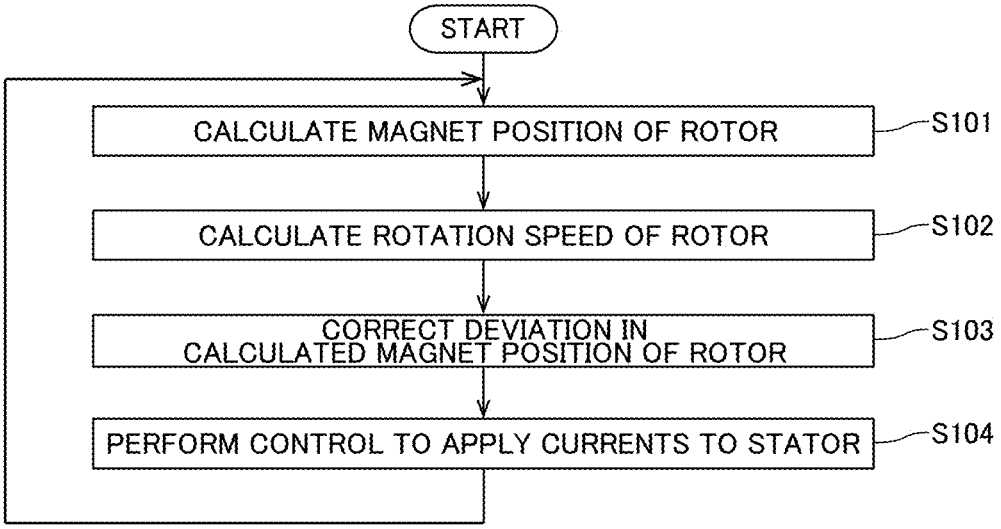
FIG. 9 is a diagram showing a control flow by a controller of a marine propulsion device according to an example embodiment of the present invention.

As shown in FIG. 9, in step S101, the controller 70 calculates the magnet position MP of the rotor 54 based on the magnetic flux densities MD detected by the detectors 60. Specifically, the detectors 60 output the detection signals DS to the controller 70 based on the timing at which the magnetic flux densities MD exceed the predetermined threshold TH. Then, the controller 70 calculates the magnet position MP of the rotor 54 based on the detection signals DS input from the detectors 60.

Then, in step S102, the controller 70 calculates the rotation speed TN of the rotor 54 based on the magnetic flux densities MD detected by the detectors 60. Specifically, the controller 70 calculates the rotation speed TN of the rotor 54 based on a length of time for one cycle of the magnetic flux densities MD detected by the detectors 60, which corresponds to an electrical angle of 360 degrees. The process operation in step S102 may be performed before step S101.

Then, in step S103, the controller 70 corrects the deviation in the calculated magnet position MP of the rotor 54 due to the eddy currents generated in the metal MM based on the calculated rotation speed TN of the rotor 54. Specifically, the storage 80 stores the correction information CI indicating the relationship between the rotation speed TN of the rotor 54 and the correction value CV to correct the deviation in the calculated magnet position MP of the rotor 54. Then, the controller 70 corrects the deviation in the calculated magnet position MP of the rotor 54 due to the eddy currents generated in the metal MM based on the calculated rotation speed TN of the rotor 54 and the correction information CI stored in the storage 80.

Then, in step S104, the controller 70 performs a control to apply three-phase alternating currents to the coils of the stator 44 at the timing at which the rotor 54 is able to obtain a maximum torque based on the calculated magnet position MP of the rotor 54 with the corrected deviation.

The process operations in step S101 to step S104 are repeated until the controller 70 finishes a control to apply three-phase alternating currents to the coils of the stator 44.

According to the various example embodiments of the present invention described above, the following advantageous effects are achieved.

According to an example embodiment of the present invention, the controller 70 is configured or programmed to calculate the rotation speed TN of the rotor 54 based on the magnetic flux densities MD detected by the detectors 60, and correct the deviation in the calculated magnet position MP of the rotor 54 due to the eddy currents generated in the metal MM based on the calculated rotation speed TN of the rotor 54. Accordingly, even when a deviation occurs in the calculated magnet position MP of the rotor 54 due to the eddy currents generated in the metal MM, the deviation in the calculated magnet position of the rotor 54 due to the eddy currents generated in the metal MM is corrected based on the rotation speed TN of the rotor 54. The rotation speed TN of the rotor 54 is calculated based on a length of time for one cycle of the magnetic flux densities MD corresponding to an electrical angle of 360 degrees, and thus the rotation speed TN of the rotor 54 is accurately detected even when a deviation occurs in the calculated magnet position of the rotor. Therefore, currents are applied to the stator 44 at the timing at which the rotor 54 is able to obtain a maximum torque based on the calculated magnet position MP of the rotor 54 with the corrected deviation. That is, the rotor 54 obtains the maximum torque. Consequently, in a structure including the duct 40 including the stator 44, and the propeller 50 including the rim 51 that includes the rotor 54 facing the stator 44, an output of the motor including the stator 44 and the rotor 54 is improved.

According to an example embodiment of the present invention, the detectors 60 are adjacent to the stator 44 in the A direction (the axial direction of the rotor 54) and face the rotor 54. Accordingly, even when the rotor 54 faces the stator 44, the detectors 60 face the rotor 54.

According to an example embodiment of the present invention, the detectors 60 are accommodated in the space S1 inside the storage area 45 made of the metal MM and located in the upper portion of the duct 40. Accordingly, the detectors 60 are located on the relatively upper side of the duct 40. Therefore, as compared with a case in which the detectors 60 are accommodated in a portion of the duct 40 other than the storage area 45 located in the upper portion, the detectors 60 are located relatively close to the controller 70 generally located above the duct 40. Consequently, complex routing of signal lines connecting the detectors 60 to the controller 70 is reduced or prevented.

According to an example embodiment of the present invention, the marine propulsion device 100 includes the lower case 30 (housing) above the duct 40. The controller 70 is accommodated in the space S2 inside the lower case 30. The space S1 inside the storage area 45 in which the detectors 60 are accommodated is connected to the space S2 inside the lower case 30 in which the controller 70 is accommodated. Accordingly, the space S1 in which the detectors 60 are accommodated is connected to the space S2 in which the controller 70 is accommodated, and thus the signal lines connecting the detectors 60 to the controller 70 are easily routed.

According to an example embodiment of the present invention, three-phase AC power is supplied to the stator 44. The three detectors 60 are provided to detect the three-phase magnetic flux densities MD generated by the magnet of the rotor 54, respectively. The controller 70 is configured or programmed to calculate the rotation speed TN of the rotor 54 based on one of the three-phase magnetic flux densities MD detected by the three detectors 60, respectively, and correct the deviations in the magnet positions MP of the rotor 54 calculated based on the three-phase magnetic flux densities MD, respectively, based on the calculated rotation speed TN of the rotor 54. Accordingly, in a structure in which three-phase AC power is supplied, the rotor 54 obtains the maximum torque.

According to an example embodiment of the present invention, the three detectors 60 are aligned along the W direction (alignment direction) perpendicular to the A direction (the axial direction of the rotor 54) in the horizontal plane. The thickness t1 of the metal MM between the rotor 54 and the detector 61 located at the center in the W direction among the three detectors 60 is different from the thickness t2 of the metal MM between the rotor 54 and the detector 62 located on the W1 side (the first side in the W direction) among the three detectors 60 and the thickness t3 of the metal MM between the rotor 54 and the detector 63 located on the W2 side (the second side in the W direction) among the three detectors 60. Accordingly, the width of the gap G between a surface of the metal MM on the rotor 54 side and the outer peripheral surface 51*a* of the rim 51 including the rotor 54 at a position corresponding to the detector 61 located at the center in the W direction is smaller than the width of the gap G between the surface of the metal MM on the rotor 54 side and the outer peripheral surface 51*a* of the rim 51 including the rotor 54 at a position corresponding to the detector 62 located on the W1 side in the W direction and the width of the gap G between the surface of the metal MM on the rotor 54 side and the outer peripheral surface 51*a* of the rim 51 including the rotor 54 at a position corresponding to the detector 63 located on the W2 side in the W direction. Consequently, even when the three detectors 60 are aligned along the W direction perpendicular to the A direction in the horizontal plane, an excessively uneven width of the gap G between the inner peripheral surface 40*a* of the duct 40 and the outer peripheral surface 51*a* of the rim 51 is reduced or prevented.

According to an example embodiment of the present invention, the marine propulsion device 100 includes the storage 80 to store the correction information CI indicating the relationship between the rotation speed TN of the rotor 54 and the correction value CV to correct the deviation in the calculated magnet position MP of the rotor 54. The controller 70 is configured or programmed to correct the deviation in the calculated magnet position MP of the rotor 54 based on the calculated rotation speed TN of the rotor 54 and the correction information CI. Accordingly, the deviation in the calculated magnet position MP of the rotor 54 is easily corrected based on the calculated rotation speed TN of the rotor 54 and the correction information CI stored in the storage 80.

According to an example embodiment of the present invention, the storage 80 is operable to store the correction information CI for the entire range of the rotation speed TN of the rotor 54. Accordingly, the deviation in the calculated magnet position MP of the rotor 54 is easily corrected over the entire range of the rotation speed TN of the rotor 54.

According to an example embodiment of the present invention, the storage 80 is operable to store the correction information CI represented by the mathematical formula. Accordingly, the correction information is easily stored in the storage 80 using the mathematical formula.

According to an example embodiment of the present invention, the controller 70 is configured or programmed to calculate the correction value CV based on the calculated rotation speed TN of the rotor 54 and the correction information CI represented by the mathematical formula, and correct the deviation in the calculated magnet position MP of the rotor 54 based on the calculated correction value CV. Accordingly, when the correction information CI is stored in the storage 80 using the mathematical formula, the deviation in the calculated magnet position MP of the rotor 54 is easily corrected based on the calculated rotation speed TN of the rotor 54 and the correction information CI stored in the storage 80.

The example embodiments of the present invention described above are illustrative in all points and not restrictive. The extent of the present invention is not defined by the above description of the example embodiments but by the scope of the claims, and all modifications within the meaning and range equivalent to the scope of the claims are further included.

For example, while the storage 80 preferably stores the correction information CI represented by the mathematical formula in example embodiments described above, the present invention is not restricted to this. In an example embodiment of the present invention, the storage may alternatively store correction information represented by a map or a table, for example.

While the storage 80 preferably stores the correction information CI for the entire range of the rotation speed TN of the rotor 54 in example embodiments described above, the present invention is not restricted to this. In an example embodiment of the present invention, the storage may alternatively store correction information only for a partial range of the rotation speed of the rotor.

While the three detectors 60 are preferably aligned along the W direction (alignment direction) perpendicular to the A direction (the axial direction of the rotor 54) in the horizontal plane, and the thickness t1 of the metal MM between the rotor 54 and the detector 61 located at the center in the W direction among the three detectors 60 is preferably different from the thickness t2 of the metal MM between the rotor 54 and the detector 62 located on the W1 side (the first side in the W direction) among the three detectors 60 and the thickness t3 of the metal MM between the rotor 54 and the detector 63 located on the W2 side (the second side in the W direction) among the three detectors 60 in example embodiments described above, the present invention is not restricted to this. In an example embodiment of the present invention, three detectors may alternatively be aligned along the circumferential direction of the rotor, and the thickness of the metal between the rotor and a detector located at the center in the circumferential direction of the rotor among the three detectors may alternatively be equal to or substantially equal to the thickness of the metal between the rotor and a detector located on a first side in the circumferential direction of the rotor among the three detectors and the thickness of the metal between the rotor and a detector located on a second side in the circumferential direction of the rotor among the three detectors.

While the thickness t2 of the metal MM between the rotor 54 and the detector 62 located on the W1 side (the first side in the W direction (the alignment direction perpendicular to the axial direction of the rotor 54 in the horizontal plane)) among the three detectors 60 is preferably the same or substantially the same as the thickness t3 of the metal MM between the rotor 54 and the detector 63 located on the W2 side (the second side in the W direction) among the three detectors 60 in example embodiments described above, the present invention is not restricted to this. In an example embodiment of the present invention, the thickness of the metal between the rotor and the detector located on the first side in the alignment direction among the three detectors may alternatively be different from the thickness of the metal between the rotor and the detector located on the second side in the alignment direction among the three detectors.

While three-phase AC power is preferably supplied to the stator 44, three detectors are preferably provided to detect the three-phase magnetic flux densities MD generated by the magnet of the rotor 54, respectively, and the controller 70 preferably calculates the rotation speed TN of the rotor 54 based on one of the three-phase magnetic flux densities MD detected by the three detectors 60, respectively, and performs a control to correct the deviations in the magnet positions MP of the rotor 54 calculated based on the three-phase magnetic flux densities MD, respectively, based on the calculated rotation speed TN of the rotor 54 in example embodiments described above, the present invention is not restricted to this. In an example embodiment of the present invention, two-phase AC power may alternatively be supplied to the stator, two detectors may alternatively be provided to detect two-phase magnetic flux densities generated by the magnet of the rotor, respectively, and the controller may alternatively calculate the rotation speed of the rotor based on one of the two-phase magnetic flux densities detected by the two detectors, respectively, and correct deviations in magnet positions of the rotor calculated based on the two-phase magnetic flux densities, respectively, based on the calculated rotation speed of the rotor. Alternatively, single-phase AC power may be supplied to the stator, only one detector may alternatively be provided to detect a single-phase magnetic flux density generated by the magnet of the rotor, and the controller may calculate the rotation speed of the rotor based on the single-phase magnetic flux density detected by one detector, and correct a deviation in a magnet position of the rotor calculated based on the single-phase magnetic flux density based on the calculated rotation speed of the rotor.

While the space S1 inside the storage area 45 in which the detectors 60 are accommodated is preferably connected to the space S2 inside the lower case 30 (housing) in which the controller 70 is accommodated in example embodiments described above, the present invention is not restricted to this. In an example embodiment of the present invention, the space inside the storage area in which the detectors are accommodated may not be connected to the space inside the housing in which the controller is accommodated.

While the detectors 60 are preferably accommodated in the space S1 inside the storage area 45 made of the metal MM and located in the upper portion of the duct 40 in example embodiments described above, the present invention is not restricted to this. In an example embodiment of the present invention, the detectors may alternatively be accommodated in a portion other than the storage area made of the metal and located in the upper portion of the duct.

While the detectors 60 are preferably adjacent to the stator 44 in the A direction (the axial direction of the rotor 54) and preferably face the rotor 54 in example embodiments described above, the present invention is not restricted to this. In an example embodiment of the present invention, the detectors may alternatively face the rotor without being adjacent to the stator in the axial direction of the rotor.

While the marine propulsion device 100 is preferably an outboard motor attached to the hull 101 in example embodiments described above, the present invention is not restricted to this. In an example embodiment of the present invention, the marine propulsion device may alternatively be an inboard motor provided inside the hull, or an inboard-outboard motor attached to the hull such that a portion of the inboard-outboard motor is provided inside the hull.

While example embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A marine propulsion device comprising:

a duct including a stator;

a propeller including a rim including a rotor radially inward of the stator and facing the stator, and blades radially inward of the rim;

a detector facing the rotor via a metal to detect a magnetic flux density generated by a magnet of the rotor; and a controller configured or programmed to calculate a magnet position of the rotor based on the magnetic flux density detected by the detector, and perform a control to apply a current to the stator at a timing at which the rotor is able to obtain a maximum torque based on a calculated magnet position of the rotor; wherein the controller is configured or programmed to calculate a rotation speed of the rotor based on the magnetic flux density detected by the detector, and correct a deviation in the calculated magnet position of the rotor due to an eddy current generated in the metal based on the calculated rotation speed of the rotor.

2. The marine propulsion device according to claim 1, wherein the detector is adjacent to the stator in an axial direction of the rotor, and faces the rotor.

3. The marine propulsion device according to claim 2, wherein the detector is accommodated in a space inside a storage area defined by the metal and located in an upper portion of the duct.

4. The marine propulsion device according to claim 3, further comprising:

a housing above the duct; wherein the controller is accommodated in a space inside the housing; and the space inside the storage area in which the detector is accommodated is connected to the space inside the housing in which the controller is accommodated.

5. The marine propulsion device according to claim 1, wherein three-phase AC power is supplied to the stator;

the detector includes three detectors to detect three-phase magnetic flux densities generated by the magnet of the rotor, respectively; and the controller is configured or programmed to calculate the rotation speed of the rotor based on one of the three-phase magnetic flux densities detected by the three detectors, respectively, and correct deviations in magnet positions of the rotor calculated based on the three-phase magnetic flux densities, respectively, based on the calculated rotation speed of the rotor.

6. The marine propulsion device according to claim 5, wherein the three detectors are aligned along an alignment direction perpendicular to an axial direction of the rotor in a horizontal plane; and a thickness of the metal between the rotor and one of the three detectors located at a center in the alignment direction is different from a thickness of the metal between the rotor and another one of the three detectors located on a first side in the alignment direction and a thickness of the metal between the rotor and another one of the three detectors located on a second side in the alignment direction.

7. The marine propulsion device according to claim 1, further comprising:

a storage to store correction information indicating a relationship between the rotation speed of the rotor and a correction value to correct the deviation in the calculated magnet position of the rotor; wherein the controller is configured or programmed to correct the deviation in the calculated magnet position of the rotor based on the calculated rotation speed of the rotor and the correction information.

8. The marine propulsion device according to claim 7, wherein the storage is operable to store the correction information for an entire range of the rotation speed of the rotor.

9. The marine propulsion device according to claim 7, wherein the storage is operable to store the correction information represented by a mathematical formula, a map, or a table.

10. The marine propulsion device according to claim 9, wherein the storage is operable to store the correction information represented by the mathematical formula; and the controller is configured or programmed to calculate the correction value based on the calculated rotation speed of the rotor and the correction information represented by the mathematical formula, and correct the deviation in the calculated magnet position of the rotor based on the calculated correction value.

11. A marine vessel comprising:

a hull; and a marine propulsion device attached to the hull; wherein the marine propulsion device includes:

a duct including a stator;

a propeller including a rim including a rotor radially inward of the stator and facing the stator, and blades radially inward of the rim;

a detector facing the rotor via a metal to detect a magnetic flux density generated by a magnet of the rotor; and a controller configured or programmed to calculate a magnet position of the rotor based on the magnetic flux density detected by the detector, and perform a control to apply a current to the stator at a timing at which the rotor is able to obtain a maximum torque based on the calculated magnet position of the rotor; and the controller is configured or programmed to calculate a rotation speed of the rotor based on the magnetic flux density detected by the detector, and correct a deviation in the calculated magnet position of the rotor due to an eddy current generated in the metal based on the calculated rotation speed of the rotor.

12. The marine vessel according to claim 11, wherein the detector is adjacent to the stator in an axial direction of the rotor and faces the rotor.

13. The marine vessel according to claim 12, wherein the detector is accommodated in a space inside a storage area defined by the metal and located in an upper portion of the duct.

14. The marine vessel according to claim 13, wherein the marine propulsion device further includes a housing above the duct;

the controller is accommodated in a space inside the housing; and the space inside the storage area in which the detector is accommodated is connected to the space inside the housing in which the controller is accommodated.

15. The marine vessel according to claim 11, wherein three-phase AC power is supplied to the stator;

the detector includes three detectors to detect three-phase magnetic flux densities generated by the magnet of the rotor, respectively; and the controller is configured or programmed to calculate the rotation speed of the rotor based on one of the three-phase magnetic flux densities detected by the three detectors, respectively, and correct deviations in magnet positions of the rotor calculated based on the three-phase magnetic flux densities, respectively, based on the calculated rotation speed of the rotor.

16. The marine vessel according to claim 15, wherein the three detectors are aligned along an alignment direction perpendicular or substantially perpendicular to an axial direction of the rotor in a horizontal plane; and a thickness of the metal between the rotor and one of the three detectors located at a center in the alignment direction is different from a thickness of the metal between the rotor and another one of the three detectors located on a first side in the alignment direction and a thickness of the metal between the rotor and another one of the three detectors located on a second side in the alignment direction.

17. The marine vessel according to claim 11, wherein the marine propulsion device further includes a storage to store correction information indicating a relationship between the rotation speed of the rotor and a correction value to correct the deviation in the calculated magnet position of the rotor; and the controller is configured or programmed to correct the deviation in the calculated magnet position of the rotor based on the calculated rotation speed of the rotor and the correction information.

18. The marine vessel according to claim 17, wherein the storage is operable to store the correction information for an entire range of the rotation speed of the rotor.

19. The marine vessel according to claim 17, wherein the storage is operable to store the correction information represented by a mathematical formula, a map, or a table.

20. The marine vessel according to claim 19, wherein the storage is operable to store the correction information represented by the mathematical formula; and the controller is configured or programmed to calculate the correction value based on the calculated rotation speed of the rotor and the correction information represented by the mathematical formula, and correct the deviation in the calculated magnet position of the rotor based on the calculated correction value.

* * * * *